US011293391B2

(12) United States Patent
Sato et al.

(10) Patent No.: US 11,293,391 B2
(45) Date of Patent: Apr. 5, 2022

(54) DAMPER DEVICE

(71) Applicant: EAGLE INDUSTRY CO., LTD., Tokyo (JP)

(72) Inventors: Yusuke Sato, Tokyo (JP); Toshiaki Iwa, Tokyo (JP); Yoshihiro Ogawa, Tokyo (JP)

(73) Assignee: EAGLE INDUSTRY CO., LTD.

( * ) Notice: Subject to any disclaimer, the term of this patent is extended or adjusted under 35 U.S.C. 154(b) by 0 days.

(21) Appl. No.: 17/048,980

(22) PCT Filed: May 17, 2019

(86) PCT No.: PCT/JP2019/019618

§ 371 (c)(1),
(2) Date: Oct. 19, 2020

(87) PCT Pub. No.: WO2019/221260

PCT Pub. Date: Nov. 21, 2019

(65) Prior Publication Data

US 2021/0239080 A1 Aug. 5, 2021

(30) Foreign Application Priority Data

May 18, 2018 (JP) ..... JP2018-096189

(51) Int. Cl.
*F02M 55/04* (2006.01)
*F02M 59/44* (2006.01)
*F02M 59/36* (2006.01)

(52) U.S. Cl.
CPC ..... *F02M 55/04* (2013.01); *F02M 59/36* (2013.01); *F02M 59/44* (2013.01); *F02M 2200/315* (2013.01)

(58) Field of Classification Search
CPC .... F02M 55/04; F02M 59/44; F02M 37/0041; F02M 2200/315; F16J 3/02;
(Continued)

(56) References Cited

U.S. PATENT DOCUMENTS 3,020,928 A * 2/1962 Peet ..... F15B 1/16 138/30
4,728,085 A * 3/1988 Bebermeier ..... F16F 13/106 267/122
(Continued)

FOREIGN PATENT DOCUMENTS

CN 1219993 6/1999 ..... F01B 19/00
CN 103097716 5/2013 ..... F02M 59/44
(Continued)

OTHER PUBLICATIONS

Machine translation of Description JP2012197732A translate provided by Espacenet (Year: 2021).*
(Continued)

*Primary Examiner* — Michael A Kessler
(74) *Attorney, Agent, or Firm* — Hayes Soloway P.C.

(57) ABSTRACT

A damper device includes at least a diaphragm, an opposite member that faces the diaphragm and is connected to the diaphragm in a hermetically sealed state over a circumferential direction, and a deformation-suppressing member that is disposed in a hermetically sealed space defined by the diaphragm and the opposite member. The deformation-suppressing member includes a central portion that includes a concave surface of which a depth is increased toward a center in a radial direction thereof, and protruding portions that are provided closer to an outer peripheral side than the central portion.

8 Claims, 8 Drawing Sheets

(58) Field of Classification Search
CPC ... F04B 11/0016; F16F 13/105; F16F 13/106; F16L 55/05–053
See application file for complete search history.

(56) References Cited

U.S. PATENT DOCUMENTS

| | | | | |
|---|---|---|---|---|
| 5,743,170 | A | 4/1998 | Pascual et al. | 92/103 |
| 7,004,733 | B2 | 2/2006 | Schepp | B60T 8/4031 |
| 8,366,421 | B2 | 2/2013 | Munakata | 417/540 |
| 8,562,315 | B2 | 10/2013 | Inoue | 417/540 |
| 8,727,752 | B2 | 5/2014 | Lucas | 417/541 |
| 8,757,212 | B2 | 6/2014 | Bartsch | 138/30 |
| 8,955,550 | B2 | 2/2015 | Oikawa | 138/30 |
| 9,057,348 | B2 | 2/2015 | Usui | F02M 55/04 |
| 9,803,600 | B2 | 10/2017 | Nah | F02M 37/0041 |
| 9,828,988 | B2 | 11/2017 | Koehler | F02M 59/44 |
| 10,480,466 | B2 | 11/2019 | Tomitsuka et al. | F02M 37/0041 |
| 10,480,704 | B2 | 11/2019 | Yoshida | F02M 55/00 |
| 10,544,768 | B2 | 1/2020 | Kashiwagi | F02M 59/44 |
| 10,718,296 | B2 | 6/2020 | Hayatani et al. | |
| 10,753,331 | B2 | 8/2020 | Iwa | F16F 1/048 |
| 2002/0153209 | A1 | 10/2002 | Nagy | F16F 9/04 |
| 2003/0164161 | A1 | 9/2003 | Usui | F02M 59/366 |
| 2005/0019188 | A1 | 1/2005 | Usui et al. | F04B 11/00 |
| 2006/0071381 | A1* | 4/2006 | Hatakeyama | F16F 13/106 267/140.13 |
| 2006/0272144 | A1 | 12/2006 | Matsuki | B23K 26/125 |
| 2007/0079810 | A1 | 4/2007 | Usui | F02M 63/028 |
| 2008/0175735 | A1 | 7/2008 | Lucas | F02M 37/0041 |
| 2008/0289713 | A1 | 11/2008 | Munakata et al. | 138/26 |
| 2009/0288639 | A1 | 11/2009 | Usui et al. | 123/457 |
| 2010/0209274 | A1 | 8/2010 | Oikawa | F04B 53/004 |
| 2010/0215529 | A1 | 8/2010 | Inoue | F04B 53/002 |
| 2011/0103985 | A1 | 5/2011 | Mancini et al. | F04B 11/00 |
| 2011/0108007 | A1 | 5/2011 | Manchini | F04B 1/0448 |
| 2011/0110807 | A1 | 5/2011 | Kobayashi | F04B 1/0452 |
| 2011/0110808 | A1 | 5/2011 | Inoue | F04B 11/0033 |
| 2011/0209687 | A1 | 9/2011 | Schroeder et al. | F02M 69/00 |
| 2011/0247488 | A1 | 10/2011 | Oikawa | F02M 59/44 |
| 2012/0006303 | A1 | 1/2012 | Usui | F02M 59/44 |
| 2012/0087817 | A1* | 4/2012 | Lucas | F04B 1/0404 417/540 |
| 2012/0195780 | A1 | 8/2012 | Matsumoto | F02M 59/02 |
| 2013/0001842 | A1* | 1/2013 | Kanaya | F16F 13/106 267/140.13 |
| 2013/0052064 | A1 | 2/2013 | Oikawa | F04B 11/0016 |
| 2013/0209289 | A1 | 8/2013 | Lucas | F04B 43/02 |
| 2013/0230417 | A1 | 9/2013 | Kobayashi | F16L 55/0338 |
| 2013/0276929 | A1 | 10/2013 | Oikawa | F02M 59/102 |
| 2014/0193280 | A1 | 7/2014 | Saito | F04B 11/00 |
| 2014/0216418 | A1 | 8/2014 | Asayama | F02M 69/02 |
| 2015/0017040 | A1* | 1/2015 | Hishinuma | F02M 55/04 417/540 |
| 2015/0132165 | A1 | 5/2015 | Inoue | F02M 37/043 |
| 2015/0260133 | A1* | 9/2015 | Iwa | F02M 37/0041 92/47 |
| 2015/0260182 | A1 | 9/2015 | Kobayashi et al. | F04B 43/02 |
| 2016/0169173 | A1 | 6/2016 | Yabuuchi | F02M 59/44 |
| 2016/0195084 | A1 | 7/2016 | Koehler | F02M 55/04 |
| 2016/0298581 | A1 | 10/2016 | Nah et al. | F02M 37/0041 |
| 2017/0276130 | A1 | 9/2017 | Usui et al. | F04B 53/14 |
| 2017/0335810 | A1 | 11/2017 | Tomitsuka et al. | F02M 37/0041 |
| 2017/0350354 | A1 | 12/2017 | Ostrosky et al. | F02M 37/00 |
| 2018/0171992 | A1 | 6/2018 | Saito | F02M 59/44 |
| 2018/0195478 | A1 | 7/2018 | Iwa | F16F 1/06 |
| 2018/0202401 | A1 | 7/2018 | Iwa et al. | F02M 55/04 |
| 2018/0209389 | A1 | 7/2018 | Iwa | F16L 55/054 |
| 2018/0223782 | A1 | 8/2018 | Yabuuchi et al. | F02M 55/04 |
| 2018/0274525 | A1 | 9/2018 | Schretling | F04B 11/00 |
| 2018/0306368 | A1 | 10/2018 | Yoshida et al. | F16L 55/053 |
| 2018/0328322 | A1* | 11/2018 | Kashiwagi | F16L 55/053 |
| 2019/0024646 | A1 | 1/2019 | Kurt | F04B 11/0033 |
| 2019/0048837 | A1 | 2/2019 | Mikhaylov | F04B 53/16 |
| 2019/0063388 | A1 | 2/2019 | Kurt | F02M 55/04 |
| 2019/0152455 | A1 | 5/2019 | Kai | B60T 17/00 |
| 2019/0285032 | A1 | 9/2019 | Mikhaylov | F04B 53/16 |
| 2021/0164430 | A1 | 6/2021 | Sato | F02M 59/44 |
| 2021/0215127 | A1 | 7/2021 | Kashiwagi | F02M 59/36 |
| 2021/0239080 | A1 | 8/2021 | Sato | F02M 59/36 |
| 2021/0246860 | A1 | 8/2021 | Iwa | F02M 59/48 |
| 2021/0285589 | A1 | 9/2021 | Iwa | F04B 11/0033 |

FOREIGN PATENT DOCUMENTS

| | | | | |
|---|---|---|---|---|
| CN | 104066968 | | 9/2014 | F02M 59/34 |
| CN | 107002615 | | 8/2017 | F02N 59/44 |
| CN | 107429642 | | 12/2017 | F02M 33/00 |
| DE | 10 2014 219 997 | | 4/2016 | F04B 11/00 |
| DE | 10 2015 219 537 | | 4/2017 | F04B 11/00 |
| DE | 10 2015 219 768 | | 4/2017 | F02M 55/04 |
| DE | 10 2015 223 159 | | 6/2017 | F02M 37/00 |
| DE | 10 2016 203 217 | | 8/2017 | F02M 55/04 |
| DE | 10 2016 205 428 | | 10/2017 | F04B 11/00 |
| JP | 10-299609 | | 11/1998 | F02M 55/00 |
| JP | 2005-42554 | | 2/2005 | F02M 59/44 |
| JP | 2007-218264 | | 8/2007 | F02M 55/00 |
| JP | 2008-14319 | | 1/2008 | F02M 59/44 |
| JP | 2009-264239 | | 11/2009 | F02M 59/44 |
| JP | 2012-197732 | | 10/2012 | F02M 59/44 |
| JP | 2013-64364 | | 4/2013 | F02M 59/44 |
| JP | 2014-190188 | | 10/2014 | F02M 55/02 |
| JP | 2015017585 | A * | 1/2015 | |
| JP | 2015017621 | A * | 1/2015 | |
| JP | 2015-232283 | | 12/2015 | F02M 55/00 |
| JP | 2016-113922 | | 6/2016 | F02M 59/44 |
| JP | 2017-32069 | | 2/2017 | F16F 9/04 |
| JP | 2018-71443 | | 5/2018 | F02M 59/44 |
| KR | 10-2012-0090452 | | 8/2012 | F02M 59/14 |
| WO | WO 2016/190096 | | 1/2016 | F02M 59/44 |
| WO | WO 2017/022604 | | 2/2017 | F16F 9/04 |
| WO | WO 2017022603 | | 2/2017 | B23K 26/28 |
| WO | WO 2017167499 | | 10/2017 | B23K 26/28 |
| WO | WO2017195415 | | 11/2017 | |
| WO | WO-2018056109 | A1 * | 3/2018 | F02M 55/04 |

OTHER PUBLICATIONS

International Preliminary Report on Patentability issued in PCT/JP2019/019619, dated Nov. 24. 2020, with English translation, 10 pages.

International Search Report and Written Opinion issued in PCT/JP2019/019619, dated Aug. 13, 2019, with English translation, 18 pages.

International Preliminary Report on Patentability issued in PCT/JP2019/019618, dated Nov. 24, 2020, with English translation, 10pages.

International Search Report and Written Opinion issued in PCT/JP2019/019618, dated Jun. 25, 2019, with English translation, 19 pages.

International Preliminary Report on Patentability issued in PCT/JP2019/019616, dated Nov. 24.2020, with English translation, 6 pages.

International Search Report and Written Opinion issued in PCT/JP2019/019616, dated Jul. 9, 2019, with English translation, 11 pages.

International Preliminary Report on Patentability issued in PCT/JP2019/020195, dated Dec. 1, 2020, with English translation, 7 pages.

International Search Report and Written Opinion issued in PCT/JP2019/020195, dated Jul. 30, 2019, with English translation, 12 pages.

International Preliminary Report on Patentability issued in PCT/JP2019/019615, dated Nov. 24, 2020, with English translation, 7 pages.

International Search Report and Written Opinion issued in PCT/JP2019/019615, dated Aug. 13. 2019, with English translation, 15 pages.

(56) References Cited

OTHER PUBLICATIONS

Official Action dated Jun. 18, 2021, issued in related U.S. Appl. No. 17/050,422, 15 pages.
Official Action dated Aug. 26, 2021, issued in related U.S. Appl. No. 17/052,168, 29 pages.
U.S. Appl. No. 17/048,568, filed Oct. 16, 2020, Sato et al.
U.S. Appl. No. 17/048,980, filed Oct. 19, 2020, Sato et al.
U.S. Appl. No. 17/048,992, filed Oct. 19, 2020, Iwa et al.
U.S. Appl. No. 17/050,422, filed Oct. 23, 2020, Iwa et al.
U.S. Appl. No. 17/052,168, filed Oct. 30, 2020, Iwa et al.
Official Action dated Oct. 1, 2021, issued in related U.S. Appl. No. 17/048,568, 8 pages.
Notice of Allowance dated Sep. 21, 2021, issued in related U.S. Appl. No. 17/762,111, 9 pages.
Notice of Allowance dated Oct. 19, 2021, issued in related U.S. Appl. No. 17/048,992, 7 pages.
Notice of Allowance dated Nov. 24, 2021, issued in related U.S. Appl. No. 17/052,168, 8 pages.
Notice of Allowance dated Oct. 27, 2021, issued in related U.S. Appl. No. 17/050,422, 14 pages.
Official Action dated Jun. 24, 2021, issued in related application U..S. Appl. No. 17/762,111, 21 pages.
Official Action dated Apr. 1, 2021, issued in related U.S. Appl. No. 17/762,111, 20 pages.
"Development of Optimal diaphragm-based pulsation damper structure for high-pressure GDI pump systems through design of experiments", NPL Scientific Journal Publication; retrieved Sep. 2, 2021, https://www.sciencedirect.com/science/article/pii/S0957415813000238 (Year 2013).
International Preliminary Report on Patentability issued in PCT/JP2018/042765, dated May 26, 2020, 5 pages.
International Search Report and Written Opinion issued in PCT/JP2018/042765, dated Feb. 12, 2019, with English translation, 15 pages.
Supplemental European Search Report issued in corresponding European Patent Application No. 18882045.0, dated Jun. 15, 2021, 7 pages.
Chinese Official Action issued in related Chinese Patent Application Serial No. 201880073747.6, dated Jun. 1, 2021 (17 pages).
Chinese Official Action issued in related Chinese Patent Application Serial No. 201980025963.8, dated Sep. 28, 2021 (13 pages).
Chinese Official Action issued in related Chinese Patent Application Serial No. 201980026782.7, dated Oct. 9, 2021 (11 pages).
Chinese Official Action issued in related Chinese Patent Application Serial No. 201980026783.7, dated Oct. 9, 2021 (13 pages).
Chinese Official Action issued in related Chinese Patent Application Serial No. 201980029574.2, dated Oct. 11, 2021 (12 pages).
Chinese Official Action issued in related Chinese Patent Application Serial No. 201980029484.3, dated Oct. 11, 2021 (13 pages).
Korean Official Action issued in related Korean Patent Application Serial No. 10-2020-7030274, dated Oct. 21, 2021 with translation (9 pages).

* cited by examiner (b)

(c)

(b)

(c)

DAMPER DEVICE

TECHNICAL FIELD

The present invention relates to a damper device that absorbs pulsation generated when liquid is sent by a pump or the like.

BACKGROUND ART

For example, when an engine or the like is to be driven, a high-pressure fuel pump is used to pump fuel, which is supplied from a fuel tank by a low-pressure fuel pump, to an injector. The high-pressure fuel pump pressurizes and discharges fuel by the reciprocation of a plunger that is driven by the rotation of a cam shaft of an internal-combustion engine.

As a mechanism for pressurizing and discharging fuel in the high-pressure fuel pump, an intake stroke for opening an intake valve and taking in fuel to a pressurizing chamber from a fuel chamber formed on a fuel inlet side, when the plunger is moved down, is performed first. Then, an amount adjustment stroke for returning a part of the fuel of the pressurizing chamber to the fuel chamber, when the plunger is moved up, is performed, and a pressurization stroke for pressurizing fuel, when the plunger is further moved up after the intake valve is closed, is performed. As described above, the high-pressure fuel pump repeats a cycle that includes the intake stroke, the amount adjustment stroke, and the pressurization stroke, to pressurize fuel and to discharge the fuel toward the injector. Pulsation is generated in the fuel chamber when the high-pressure fuel pump is driven as described above.

In such a high-pressure fuel pump, a damper device for reducing pulsation generated in the fuel chamber is built in the fuel chamber. The damper device includes a disc-shaped damper body in which a space between a diaphragm and a member facing the diaphragm is filled with gas in a hermetically sealed state. Since the damper body includes a deformable-action portion at the central portion of the diaphragm and the deformable-action portion is elastically deformed by fuel pressure accompanied by pulsation, the volume of the fuel chamber can be changed and pulsation is reduced.

The improvement of the durability of the damper body, which is repeatedly deformed with the pressure fluctuation of fluid, is desired in such a damper device. Accordingly, a disc-shaped elastic deformation-suppressing member is disposed in a hermetically sealed space formed in a damper body disclosed in, for example, Patent Citation 1 and substantially the entire outer surface of the deformation-suppressing member comes into contact with the inner surface of the diaphragm to suppress the deformation of the diaphragm, so that the durability of the damper device is improved.

Further, an elastic deformation-suppressing member formed in the shape of a ring is disposed in the interior space of a damper body disclosed in, for example, Patent Citation 2 at a position corresponding to the outer peripheral portion of a diaphragm and comes into contact with the outer peripheral portion of the diaphragm, which is deformed in a concave shape depending on the pressure of fluid, to suppress the deformation of the diaphragm.

Furthermore, a group of deformation-suppressing members (elastic members), which are scattered in a circumferential direction and a radial direction, are arranged in a damper body disclosed in Patent Citation 3 and the inner surface of a deformed diaphragm comes into contact with the respective deformation-suppressing members having different heights, so that the deformation of the diaphragm is suppressed.

CITATION LIST

Patent Literature

Patent Citation 1: JP 2017-32069 A (page 9, FIG. 3)
Patent Citation 2: WO 2016/190096 A (page 7, FIG. 3)
Patent Citation 3: JP 2012-197732 A (page 16, FIG. 7)

SUMMARY OF INVENTION

Technical Problem

However, since the outer surface of the disc-shaped deformation-suppressing member is formed to bulge outward along the inner surface of the diaphragm disclosed in Patent Citation 1 that is not yet deformed and has an original shape, the deformation of the diaphragm is excessively suppressed. For this reason, there is a problem that a desired pulsation-preventing function cannot be sufficiently fulfilled.

Further, in Patent Citation 2, the diaphragm starts to be deformed from the outer peripheral portion of the diaphragm supported by the deformation-suppressing member formed in the shape of a ring with the pressure fluctuation of fluid so that the center portion of the diaphragm is concave, and then returns to the original shape not yet deformed. As the result of the repetition of this deformation and return, stress locally and repeatedly acts on the outer peripheral portion of the diaphragm supported by the deformation-suppressing member. For this reason, there is a concern that cracks or damage caused by fatigue may be generated at the outer peripheral portion.

Furthermore, in Patent Citation 3, a group of deformation-suppressing members have different heights along the shape of the diaphragm to be deformed by high-pressure fluid. However, since the position of a portion, which starts to be deformed on the outer peripheral side of the diaphragm, is shifted in the radial direction without being stabilized under a certain pressure fluctuation of fluid, there is a problem that damage to the diaphragm is caused.

The present invention has been made in consideration of such a problem, and an object of the invention is to provide a damper device that can stably maintain a pulsation-preventing function obtained from the deformation of a diaphragm and can extend a service life by suppressing damage to the diaphragm.

Solution to Problem

In order to solve the above-mentioned problem, a damper device according to the present invention is provided in a flow channel of fluid for reducing pulsation of the fluid. The damper device includes at least a diaphragm, an opposite member that faces the diaphragm and is connected to the diaphragm in a hermetically sealed state over a circumferential direction, and a deformation-suppressing member that is disposed in a hermetically sealed space defined by the diaphragm and the opposite member. The deformation-suppressing member includes a central portion that includes a concave surface of which a depth is increased toward a center in a radial direction thereof, and protruding portions that are provided closer to an outer peripheral side than the central portion. According to the aforesaid characteristic, when the diaphragm is deformed by external high-pressure fluid, the concave surface of the central portion of the deformation-suppressing member can be in contact with the diaphragm along the deformed diaphragm and can distribute stress in a state where the outer peripheral portion of the diaphragm is stably supported by the protruding portions provided on the outer peripheral portion of the deformation-suppressing member disposed in the hermetically sealed space. Accordingly, the excessive deformation of the diaphragm can be suppressed and damage caused by the scratch between the diaphragm and the concave surface can be prevented, so that a service life can be extended.

It may be preferable that at least the protruding portions of the deformation-suppressing member are made of elastic material. According to this configuration, a shock, which is generated when the diaphragm comes into contact with the protruding portions of the deformation-suppressing member, can be absorbed by elasticity and damage can be prevented.

It may be preferable that the central portion and the protruding portions of the deformation-suppressing member are formed of an integrated elastic member. According to this configuration, not only the deformation-suppressing member can be easily formed but also the relative positions of the central portion and the protruding portions can be accurately set.

It may be preferable that the central portion and the protruding portions of the deformation-suppressing member are spaced apart from each other in the radial direction. According to this configuration, the deformed diaphragm can be held by the concave surface of the central portion spaced apart from the protruding portions in the radial direction in a state where the diaphragm is stably supported by the protruding portions. Accordingly, the position of an inflection point from which the diaphragm starts to be deformed can be set with high degree of freedom.

It may be preferable that the protruding portions of the deformation-suppressing member are arranged so as to be spaced apart from each other in the circumferential direction. According to this configuration, not only spaces between the protruding portions can be used as flow passages for fluid present in the hermetically sealed space but also the deformation of the diaphragm can be allowed without obstruction.

It may be preferable that a recessed portion is formed on a surface of the deformation-suppressing member on which the protruding portions are formed. According to this configuration, it is possible to adjust the internal volume of the hermetically sealed space without affecting the contact area between the diaphragm and the deformation-suppressing member.

It may be preferable that the deformation-suppressing member is provided with a through-hole penetrating the deformation-suppressing member in an axial direction. According to this configuration, since fluid present in the hermetically sealed space flows to the surface and back of the deformation-suppressing member through the through-hole, a damper function can be improved.

It may be preferable that a recess, which is recessed more than other portions of the back in the circumferential direction, is formed on a back side of the protruding portions of the deformation-suppressing member. According to this configuration, the contact between the opposite member and the recess formed on the back side of the protruding portions can be avoided. Accordingly, even though the diaphragm is in contact with the protruding portions, a shock can be absorbed without the generation of a large resistance force.

It may be preferable that a curved surface following deformation of the diaphragm is formed on a protruding end face of each of the protruding portions on a radially inward side. According to this configuration, the curved surface is formed on the inner peripheral side of the protruding end face of the protruding portion. Accordingly, not only durability can be improved since bending stress at the time of deformation of the diaphragm is distributed, but also the degree of freedom in the deformation of the diaphragm can be improved.

It may be preferable that a curved surface, which is formed along a shoulder portion formed to bulge on an outer peripheral side of the diaphragm, is formed on a protruding end face of each of the protruding portions on a radially outward side. According to this configuration, a load applied to the protruding portions from the shoulder portion formed at the outer peripheral portion of the diaphragm can be distributed.

BRIEF DESCRIPTION OF DRAWINGS

FIG. 3A is a perspective view illustrating a surface portion, FIG. 3B is a perspective view illustrating a back portion, and FIG. 3C is a cross-sectional view taken along line A-A of FIG. 3A.

FIG. 5A is a perspective view illustrating a surface portion, FIG. 5B is a perspective view illustrating a back portion, and FIG. 5C is a cross-sectional view taken along line B-B of FIG. 5A.

DESCRIPTION OF EMBODIMENTS

A mode for implementing a damper device according to the present invention will be described below on the basis of embodiments.

First Embodiment

A damper device according to a first embodiment of the present invention will be described with reference to FIGS. 1 to 4.

Figure 1:
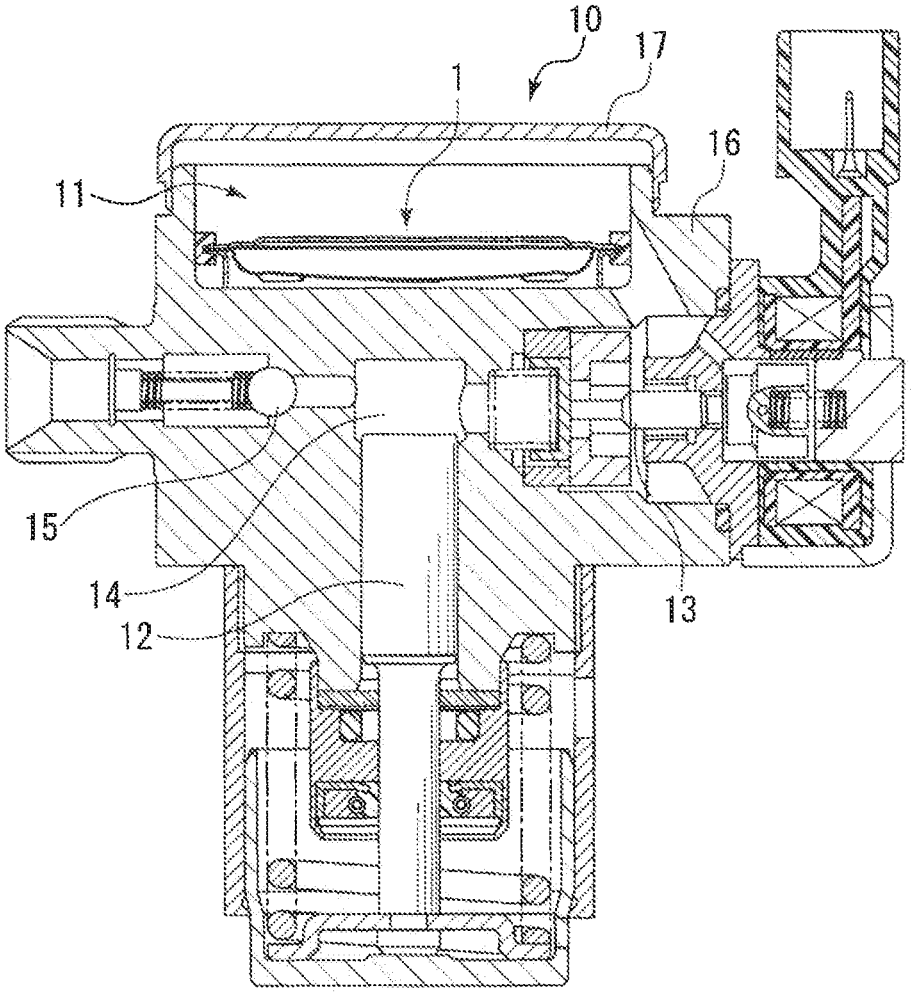
FIG. 1 is a cross-sectional view of a high-pressure fuel pump in which a damper device according to a first embodiment of the present invention is built.

As illustrated in FIG. 1, the damper device 1 according to the present embodiment is built in a high-pressure fuel pump 10 for pumping fuel, which is supplied from a fuel tank through a fuel inlet (not illustrated), toward an injector. The high-pressure fuel pump 10 pressurizes and discharges fuel by the reciprocation of a plunger 12 that is driven by the rotation of a cam shaft (not illustrated) of an internal-combustion engine.

As a mechanism for pressurizing and discharging fuel in the high-pressure fuel pump 10, an intake stroke for opening an intake valve 13 and taking in fuel to a pressurizing chamber 14 from a fuel chamber 11 formed on a fuel inlet side, when the plunger 12 is moved down, is performed first. Then, an amount adjustment stroke for returning a part of the fuel of the pressurizing chamber 14 to the fuel chamber 11, when the plunger 12 is moved up, is performed, and a pressurization stroke for pressurizing fuel, when the plunger 12 is further moved up after the intake valve 13 is closed, is performed.

As described above, the high-pressure fuel pump 10 repeats a cycle that includes the intake stroke, the amount adjustment stroke, and the pressurization stroke, to pressurize fuel, to open a discharge valve 15, and to discharge the fuel toward the injector. In this case, pulsation in which high pressure and low pressure are repeated is generated in the fuel chamber 11. The damper device 1 is used to reduce such pulsation that is generated in the fuel chamber 11 of the high-pressure fuel pump 10.

Figure 2:
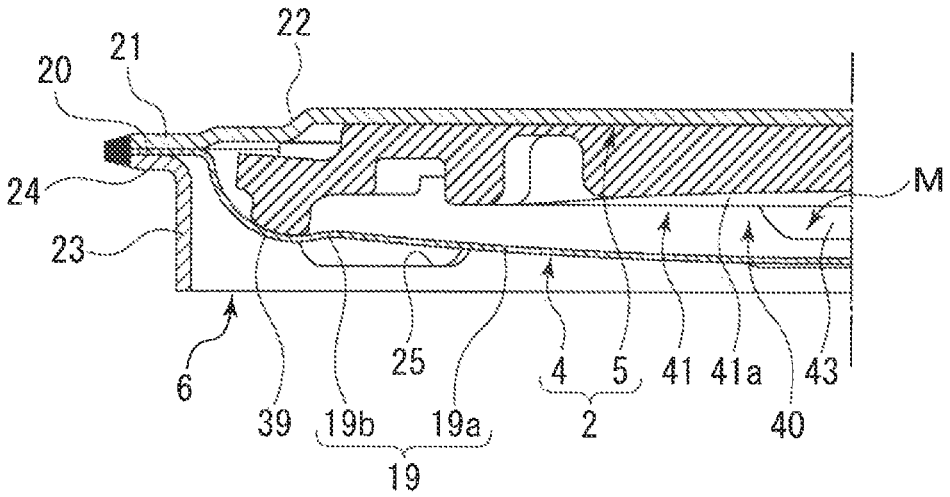
FIG. 2 is a cross-sectional view showing components of the damper device according to the first embodiment.

As illustrated in FIG. 2, the damper device 1 includes a damper body 2 in which a hermetically sealed space M is formed by a diaphragm 4 and a plate 5 (also referred as an opposite member) connected to the diaphragm 4 in a hermetically sealed state to face the diaphragm 4, and a stay member 6 that is fixed to the damper body 2.

The diaphragm 4 is formed in the shape of a dish to have a uniform thickness as a whole by the pressing of a metal plate. A deformable-action portion 19 bulging in an axial direction is formed on the radially central side of the diaphragm 4. The deformable-action portion 19 includes a main deformable portion 19*a* that gently bulges outward in the axial direction toward the center of the deformable-action portion 19 in a radial direction in a natural state, and a deformation base portion 19*b* that is positioned closer to an outer peripheral side than the main deformable portion 19*a* and protrudes inward in the axial direction. Further, an annular shoulder portion 39, which is positioned closer to the outer peripheral side than the deformation base portion 19*b* and bulges outward in the axial direction, is formed.

The main deformable portion 19*a*, the deformation base portion 19*b*, and the shoulder portion 39 of the deformable-action portion 19 are smoothly continuous with each other, and all of them are formed of curved surfaces. In a natural state, the radius of curvature of the main deformable portion 19*a* is largest and the radius of curvature of the shoulder portion 39 is larger than that of the deformation base portion 19*b*. Further, an outer peripheral edge portion 20 having the shape of an annular flat plate is formed on the outer peripheral side of the deformable-action portion 19 to extend radially outward from the deformable-action portion 19. The diaphragm 4 is adapted so that the main deformable portion 19*a* starts to be easily deformed in the axial direction from the deformation base portion 19*b* of the deformable-action portion 19 by fluid pressure in the fuel chamber 11.

The plate 5 is formed in the shape of a flat plate by the pressing of a metal plate that is thicker than the metal plate forming the diaphragm 4. The inner peripheral side of the plate 5 is formed in a planar shape having steps, and an outer peripheral edge portion 21 overlapping with the outer peripheral edge portion 20 of the diaphragm 4 is formed on the outer peripheral side of the plate 5. The plate 5 is formed in the shape of a flat plate having a thickness, and is adapted to be difficult to be deformed by fluid pressure in the fuel chamber 11. Further, an annular convex portion 22 is formed on the inside of the outer peripheral edge portion 21.

As illustrated in FIG. 2, the stay member 6 includes an annular cylindrical portion 23 which surrounds the deformable-action portion 19 of the diaphragm 4 in a circumferential direction and in which a through-hole penetrating itself in the axial direction is formed, and an outer peripheral edge portion 24 overlapping with the outer peripheral edge portion 21 of the plate 5 is formed on the outer peripheral side of the cylindrical portion 23. Further, a plurality of through-holes 25 are formed at the cylindrical portion 23 to be spaced apart from each other in the circumferential direction.

As illustrated in FIG. 2, the outer peripheral edge portion 20 of the diaphragm 4, the outer peripheral edge portion 21 of the plate 5, and the outer peripheral edge portion 24 of the stay member 6 are fixed to each other in the circumferential direction by welding. The outer peripheral edge portion 20 of the diaphragm 4 and the outer peripheral edge portion 21 of the plate 5 are fixed to each other by welding, so that a hermetically sealed space M filled with inert gas is formed in the damper body 2. An elastic deformation-suppressing member 40 for suppressing the deformation of the diaphragm 4 is disposed in the hermetically sealed space M. Further, since the diaphragm 4, the plate 5, and the stay member 6 are integrally fixed, not only it is easy to assemble the damper device 1 but also it is possible to prevent the diaphragm 4 from being broken due to a collision between the diaphragm 4 and the cylindrical portion 23 of the stay member 6.

Next, the deformation-suppressing member 40 disposed in the hermetically sealed space M of the damper body 2 will be described.

Figure 3:
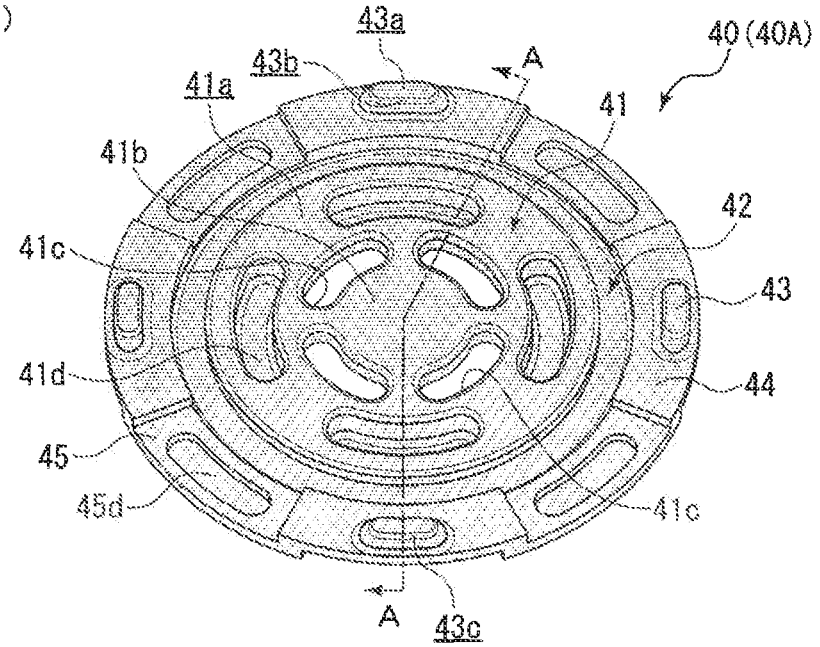
FIGS. 3A to 3C are diagrams illustrating a deformation-suppressing member in the first embodiment.
Figure 3:
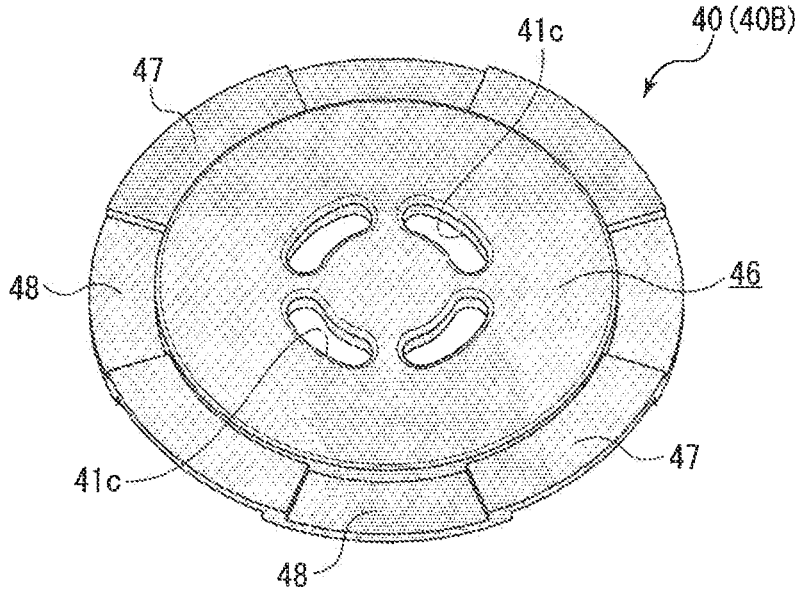
Figure 3:
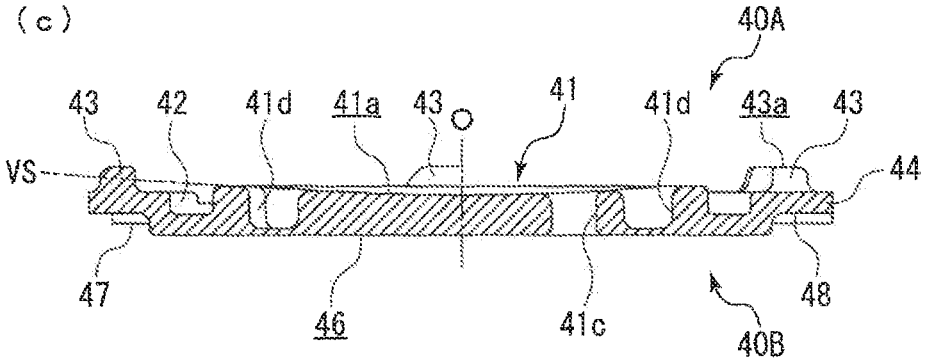

As illustrated in FIG. 3, the deformation-suppressing member 40 of the first embodiment is an elastic member that is formed in the shape of a disc as a whole in plan view, is made of, for example, silicone rubber, and is integrally molded. The deformation-suppressing member 40 is disposed in the hermetically sealed space M that is hermetically sealed by the diaphragm 4 and the plate 5 of the damper body 2.

The deformation-suppressing member 40 of the first embodiment includes a surface portion 40A that is a side to come into contact with the inner surface (that is, the surface facing the hermetically sealed space M) of the diaphragm 4, and a back portion 40B that is a side to be in contact with the inner surface (that is, the surface facing the hermetically sealed space M) of the plate 5. The surface portion 40A of the deformation-suppressing member 40 mainly includes a central portion 41 including a concave surface 41*a*, an annular groove 42, and a plurality of protruding portions 43. The concave surface 41*a* has a substantially circular shape in plan view and has the shape of a curved surface of which a depth from the diaphragm 4 is gradually increased toward a center O in the radial direction. The annular groove 42 is formed closer to the outer peripheral side than the central portion 41. The plurality of protruding portions 43 are arranged at positions closer to the outer peripheral side than the annular groove 42 to be spaced apart from each other in the circumferential direction, and protrude toward the diaphragm 4. That is, the central portion 41 and the protruding portions 43 are formed to be spaced apart from each other in the radial direction with the annular groove 42 interposed therebetween.

The surface portion 40A of the deformation-suppressing member 40 will be described. As illustrated in FIGS. 3A and 3C, first, through-holes 41*c* penetrating the surface and back of the deformation-suppressing member 40 are formed at the central portion 41 so that a center portion 41*b* in the radial direction remains. The through-holes 41*c* of the first embodiment have the shape of an elliptical opening that is curved concentrically with the center O, and are formed at four positions to be regularly arranged and spaced apart from each other in the circumferential direction.

Further, recessed portions 41*d*, which are recessed toward the back portion 40B without penetrating the deformation-suppressing member 40, are formed at portions closer to the outer peripheral side than the through-holes 41*c* of the central portion 41. The recessed portions 41*d* have the shape of an elliptical opening that is curved concentrically with the center O, are formed at four positions to be regularly arranged and spaced apart from each other in the circumferential direction, and are arranged in a phase different from the phase of the above-mentioned through-holes 41*c* in the circumferential direction.

That is, the central portion 41 of the surface portion 40A includes the concave surface 41*a* at a portion except for the through-holes 41*c* and the recessed portions 41*d*, and the concave surface 41*a* has a radius of curvature corresponding to the curvature of the deformed deformable-action portion 19 of the diaphragm 4 to be described later.

Further, the annular groove 42 is an annular groove that is recessed toward the back portion 40B without penetrating the deformation-suppressing member 40, is concentric with the center O, and has a constant width in the radial direction. The inner wall of the annular groove 42 defines the outer peripheral edge of the central portion 41, and the outer wall of the annular groove 42 defines the inner peripheral edges of base portions 44 and flat portions 45.

Next, each protruding portion 43 is formed to protrude toward the diaphragm 4 at the central position of the base portion 44 that is concentric with the center O, has a predetermined width in the radial direction, and extends in the shape of a circular arc; and each protruding portion 43 of the first embodiment includes a protruding end face 43*a* that extends in the circumferential direction. Four sets of the base portions 44 and the protruding portions 43 are formed to be regularly arranged and spaced apart from each other in the circumferential direction. Further, the flat portion 45, which has a height smaller than the height of the base portion 44, is formed between the base portions 44 adjacent to each other in the circumferential direction. Furthermore, a recessed portion 45*d*, which is recessed toward the back portion 40B without penetrating the deformation-suppressing member 40, is formed at the central position of each flat portion 45. The recessed portion 45*d* has the shape of an elliptical opening that is curved concentrically with the center O.

That is, the base portions 44 including the protruding portions 43 and the flat portions 45 including the recessed portions 45*d* are alternately arranged in the circumferential direction at positions closer to the outer peripheral side than the annular groove 42 of the surface portion 40A. Further, the protruding end faces 43*a* of the protruding portions 43 protrude toward the diaphragm 4 more than the concave surface 41*a* of at least the outer peripheral portion of the central portion 41.

Furthermore, the protruding end faces 43*a* protrude toward the diaphragm 4 more than a virtual extension surface VS that extends to the outer peripheral side with the same curvature as the concave surface 41*a*. Moreover, curved surfaces 43*b*, which have the shape of a circular arc in the circumferential direction and are formed in the radial direction, are formed at the inner peripheral edges of the protruding end faces 43*a* to follow the deformation of the diaphragm. 4 and to be continuous with the protruding end faces 43*a*; and curved surfaces 43*c*, which have the shape of a circular arc in the circumferential direction and are formed in the radial direction, are formed at the outer peripheral edges of the protruding end faces 43*a* along the shoulder portion 39, which is formed to bulge on the outer peripheral side of the diaphragm 4, to be continuous with the protruding end faces 43*a*.

It is possible to adjust the internal volume of the hermetically sealed space M by appropriately setting the volumes or the numbers of the through-holes 41*c* and the recessed portions 41*d* and 45*d* having been described above. For example, it is possible to increase a change in volume by increasing the internal volume of the hermetically sealed space M through an increase in the number of the through-holes or the recessed portions.

Next, the back portion 40B of the deformation-suppressing member 40 of the first embodiment will be described. As illustrated in FIGS. 3B and 3C, a disc-shaped end face 46, which is flat and is concentric with the center O, is spread at corresponding portions of the back portion 40B positioned on the side opposite to the central portion 41 and the annular groove 42 of the surface portion 40A and the end face 46 is in contact with the bottom of the plate 5.

Further, first stepped portions 47, which are recessed toward the surface portion 40A more than the end face 46, are formed at corresponding portions of the back portion 40B positioned on the side opposite to the flat portions 45 of the surface portion 40A and the end portions of the base portions 44 connected to both ends of the flat portions 45; and second stepped portions 48 (also referred to as recesses), which are recessed toward the surface portion 40A more than the first stepped portions 47, are formed at corresponding portions of the back portion 40B positioned on the side opposite to the portions of the central portion of the surface portion 40A except for the end portions of the base portions 44. That is, the first and second stepped portions 47 and 48 are alternately formed in the circumferential direction at positions closer to the outer peripheral side than the end face 46 of the back portion 40B.

Figure 4:
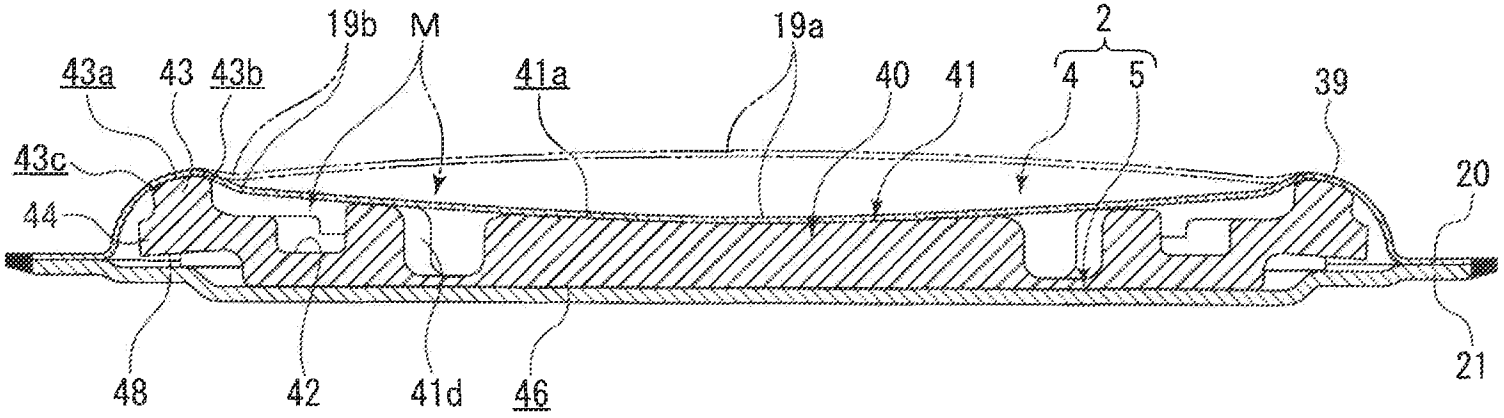
FIG. 4 is a cross-sectional view of a damper body in which the deformation-suppressing member in the first embodiment is provided.

As illustrated in FIG. 4, the deformation-suppressing member 40 of the first embodiment is disposed in the hermetically sealed space M formed between the diaphragm 4 and the plate 5 of the damper body 2, and the protruding end faces 43*a* of the protruding portions 43 are in contact with the inner surface, which is formed in a concave shape, of the shoulder portion 39 of the diaphragm 4 at four positions in an annular shape on the surface portion 40A of the deformation-suppressing member 40 in a natural state where the pressure of fluid is not applied and the main deformable portion 19*a* is not elastically deformed (hereinafter simply referred to as a natural state). For the convenience of description, the damper body 2 is illustrated to be inverted in FIG. 4.

Since the protruding portions 43 of the deformation-suppressing member 40 are fitted to the inner surface of the shoulder portion 39 of the diaphragm 4 as described above, the deformation-suppressing member 40 is positioned with respect to the diaphragm 4 in the radial direction. Accordingly, for example, even though the position of the deformation-suppressing member 40 is slightly shifted between the diaphragm 4 and the plate 5 in the radial direction at the early stage of assembly, the position of the deformation-suppressing member 40 is adjusted since the diaphragm 4 and the plate 5 are connected to each other by welding or the like.

In this contact state, the protruding portions 43 of the deformation-suppressing member 40 are pressed toward the lower side in FIG. 4 by the inner surface of the shoulder portion 39 of the diaphragm 4 and the outer peripheral portions of the base portions 44 are slightly bent down. However, since the second stepped portions 48 formed on the back side of the protruding portions 43 are spaced apart from the plate 5, the shape of the diaphragm 4 in the natural state is supported without obstruction. Further, in the natural state, other portions of the surface portion 40A except for the protruding end faces 43*a* are spaced apart from the inner surface of the diaphragm 4 without being in contact with the inner surface of the diaphragm 4.

Furthermore, most of the end face 46 of the back portion 40B of the deformation-suppressing member 40 is in surface contact with the bottom of the plate 5 in the natural state.

Next, the pulsation absorption of the damper device 1, when the damper device 1 receives fuel pressure accompanied by pulsation in which high pressure and low pressure are repeated, will be described. The hermetically sealed space M formed in the damper body 2 is filled with inert gas that is formed of argon, helium, and the like and has predetermined pressure. Meanwhile, the amount of change in the volume of the damper body 2 is adjusted using the pressure of gas to be filled in the damper body 2, so that desired pulsation absorption performance can be obtained.

When fuel pressure accompanied by pulsation is changed to high pressure from low pressure and fuel pressure generated from the fuel chamber 11 is applied to the diaphragm 4, the deformable-action portion 19 is crushed inward and the gas filled in the damper body 2 is compressed. Since the deformable-action portion 19 is elastically deformed by fuel pressure accompanied by pulsation, the volume of the fuel chamber 11 can be changed and pulsation is reduced.

Further, a space around the damper body 2 communicates with the outside of the stay member 6 through the through-holes 25 of the stay member 6.

Since a member to be in contact with a cover member 17 and a device body 16 is formed in an annular shape as described above, fuel pressure, which is accompanied by pulsation in which high pressure and low pressure generated in the fuel chamber 11 are repeated, can be made to be directly applied to the damper body 2 while the damper device 1 can be stably held in the fuel chamber 11. Accordingly, sufficient pulsation reduction performance can be ensured.

Next, the behavior of the diaphragm 4, when pulsation in which high pressure and low pressure generated in the fuel chamber 11 are repeated is accompanied, will be described. As illustrated in FIG. 4, the deformable-action portion 19 of the diaphragm 4 is deformed in a direction where inert gas filled in the hermetically sealed space M is compressed (in a downward direction) as fluid pressure in the fuel chamber 11 is increased. In detail, the main deformable portion 19*a* of the deformable-action portion 19 starts to be deformed in a concave shape from the deformation base portion 19*b* that is positioned closer to the inner peripheral side than the shoulder portion 39 being in contact with the protruding portions 43 of the deformation-suppressing member 40 in the natural state. Accordingly, the inner surface of the deformable-action portion 19 is in surface contact with the concave surface 41*a* of the central portion 41 of the deformation-suppressing member 40.

Since the concave surface 41*a* of the central portion 41 is formed of a concave curved surface having the same radius of curvature as the deformable-action portion 19 to be deformed in a concave shape, the inner surface of the deformable-action portion 19 is in surface contact with the concave surface 41*a* of the central portion 41 as a whole. The diaphragm 4 deformed by high-pressure fluid is made to be in surface contact with the curved concave surface 41*a* of the central portion 41 as described above, so that the deformed shape of the diaphragm 4 can be guided.

When the diaphragm 4 is deformed by external high-pressure fluid as described above, the concave surface 41*a* of the central portion 41 of the deformation-suppressing member 40 can be in contact with the diaphragm 4 along the deformed diaphragm 4 and can distribute stress in a state where the shoulder portion 39 (also referred to as an outer peripheral portion) of the diaphragm 4 is stably supported by the protruding portions 43 provided on the outer peripheral portion of the deformation-suppressing member 40 disposed in the hermetically sealed space M. Accordingly, the excessive deformation of the diaphragm 4 can be suppressed and damage caused by scratch can be prevented, so that a service life can be extended.

Further, when at least the protruding portions 43 of the deformation-suppressing member 40 are formed of elastic members, a shock, which is generated when the diaphragm 4 comes into contact with the protruding portions 43 of the deformation-suppressing member 40, can be absorbed by elasticity and damage can be prevented.

Furthermore, when the deformation-suppressing member 40 is formed of an integrally molded elastic member, not only the deformation-suppressing member 40 can be easily formed but also the relative positions of the central portion 41 and the protruding portions 43 can be set to be fixed.

Moreover, since the central portion 41 and the protruding portions 43 of the deformation-suppressing member 40 are spaced apart from each other in the radial direction, the deformed diaphragm 4 can be held by the concave surface 41*a* of the central portion 41 spaced apart from the protruding portions 43 in the radial direction in a state where the diaphragm 4 is stably supported by the protruding portions 43. Accordingly, the position of an inflection point from which the diaphragm 4 starts to be deformed can be set with high degree of freedom.

Further, since the protruding portions 43 of the deformation-suppressing member 40 are provided at a plurality of positions to be spaced apart from each other in the circumferential direction, not only spaces between the protruding portions 43 can be used as flow passages for gas present in the hermetically sealed space M but also the deformation of the diaphragm 4 can be allowed without obstruction.

Furthermore, since the recessed portions 41*d* and 45*d* recessed from the outer surface of the deformation-suppressing member 40 are formed on the deformation-suppressing member 40, it is possible to adjust the internal volume of the hermetically sealed space M without affecting the contact area between the diaphragm 4 and the deformation-suppressing member 40.

Further, since the through-holes 41*c* are formed at the radially central portion of the deformation-suppressing member 40, gas present in the hermetically sealed space M flows to the surface and back of the deformation-suppressing member 40 through the through-holes 41*c*. Accordingly, a damper function can be improved.

Furthermore, since the second stepped portions 48 (recesses), which are recessed more than the other portions of the back portion 40B in the circumferential direction, are formed on the portions of the back portion 40B corresponding to the protruding portions 43 of the deformation-suppressing member 40, the contact between the plate 5 (opposite member) and the second stepped portions 48 formed at the portions of the back portion 40B corresponding to the protruding portions 43 can be avoided. Accordingly, even though the diaphragm 4 is deformed and is in contact with the protruding portions 43, a shock can be absorbed without the generation of a large resistance force.

Further, the curved surfaces 43*b* following the deformation of the diaphragm 4 are formed at the inner peripheral edges of the protruding end faces 43*a* of the protruding portions 43. Accordingly, not only durability can be improved since bending stress at the time of deformation of the diaphragm. 4 is distributed by the curved surfaces 43*b*, but also the degree of freedom in the deformation of the diaphragm 4 can be improved.

Furthermore, since the curved surfaces 43*c*, which are formed along the shoulder portion 39 formed to bulge on the outer peripheral side of the diaphragm 4, are formed at the outer peripheral edges of the protruding end faces 43*a* of the protruding portions 43, a load applied to the protruding portions 43 from the shoulder portion 39 formed at the outer peripheral portion of the diaphragm 4 can be distributed.

Second Embodiment

Next, a damper device according to a second embodiment of the present invention will be described with reference to FIGS. 5 to 6. Meanwhile, the same components as those of the above-mentioned embodiment will be denoted by the same reference numerals as those of the above-mentioned embodiment, and the repeated description of the components and the effects thereof will be omitted.

Figure 5:
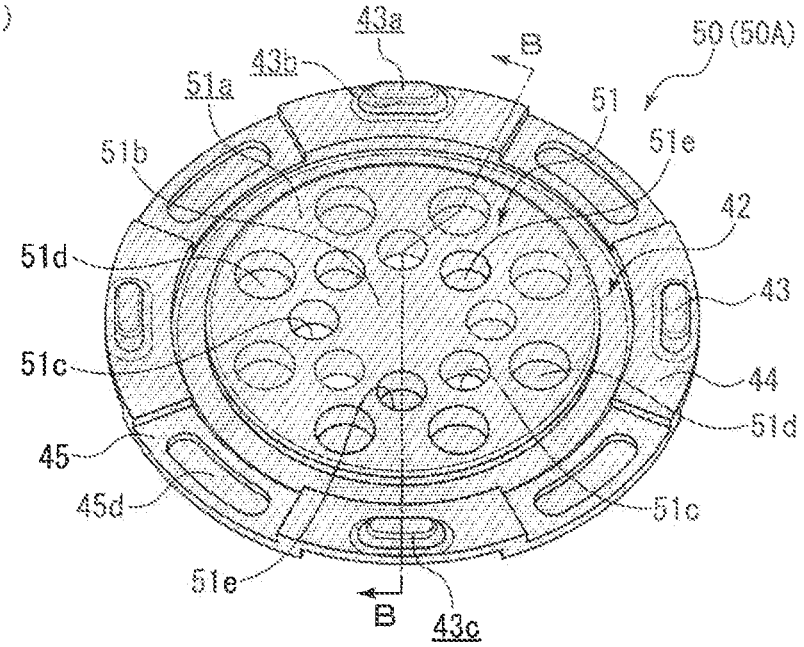
FIGS. 5A to 5C are diagrams illustrating a deformation-suppressing member of a damper device according to a second embodiment of the present invention.
Figure 5:
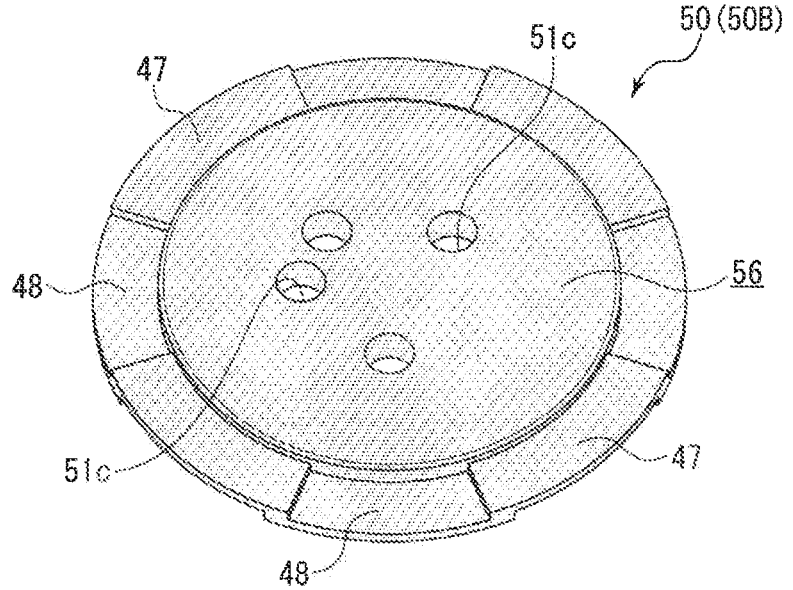
Figure 5:
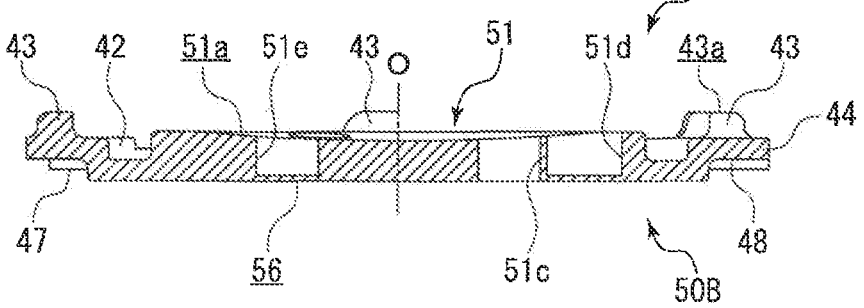

As illustrated in FIG. 5, a deformation-suppressing member 50 of the second embodiment includes a surface portion 50A that is a side to come into contact with the inner surface (that is, the surface facing the hermetically sealed space M) of the diaphragm 4, and a back portion 50B that is a side to be in contact with the inner surface (that is, the surface facing the hermetically sealed space M) of the plate 5. The surface portion 50A of the deformation-suppressing member 50 mainly includes a central portion 51 including a concave surface 51*a*, an annular groove 42, and a plurality of protruding portions 43. The concave surface 51*a* has a substantially circular shape in plan view and has the shape of a curved surface of which a height from the diaphragm 4 is gradually reduced toward a center O in the radial direction. The annular groove 42 is formed closer to the outer peripheral side than the central portion 51. The plurality of protruding portions 43 are arranged at positions closer to the outer peripheral side than the annular groove 42 to be spaced apart from each other in the circumferential direction, and protrude toward the diaphragm 4. That is, the central portion 51 and the protruding portions 43 are formed to be spaced apart from each other in the radial direction with the annular groove 42 interposed therebetween.

The surface portion 50A of the deformation-suppressing member 50 will be described. As illustrated in FIGS. 5A and 5C, first, through-holes 51*c* penetrating the surface and back of the deformation-suppressing member 50 are formed at the central portion 51 so that a center portion 51*b* in the radial direction remains. The through-holes 51*c* of the second embodiment have the shape of a circular opening, and are formed at four positions, which have the same radius from the center O, to be irregularly arranged and spaced apart from each other in the circumferential direction.

Further, recessed portions 51*e*, which are recessed toward the back portion 50B without penetrating the deformation-suppressing member 50, are formed at positions that have the same radius from the center O as the through-holes 51*c* of the central portion 51 and are different from the through-holes 51*c* in the circumferential direction. The recessed portions 51*e* have the shape of a circular opening having the same diameter as the through-hole 51*c*, and are formed at four positions to be irregularly arranged and spaced apart from each other in the circumferential direction. Furthermore, the through-holes 51*c* and the recessed portions 51*e* are formed at eight positions in total to be regularly arranged and spaced apart from each other in the circumferential direction as a whole.

Further, recessed portions 51*d*, which are recessed toward the back portion 50B without penetrating the deformation-suppressing member 50, are formed at positions closer to the outer peripheral side than the through-holes 51*c* and the recessed portions 51*e* of the central portion 51. The recessed portions 51*d* have the shape of a circular opening having a diameter larger than the diameters of the through-hole 51*c* and the recessed portion 51*e*, are formed at eight positions to be regularly arranged and spaced apart from each other in the circumferential direction, and are arranged in a phase different from the phase of the through-holes 51*c* and the recessed portions 51*e* in the circumferential direction.

Next, the back portion 50B of the deformation-suppressing member 50 of the second embodiment will be described. As illustrated in FIGS. 5B and 5C, a circular end face 56, which is flat and is concentric with the center O, is spread at corresponding portions of the back portion 50B positioned on the side opposite to the central portion 51 and the annular groove 42 of the surface portion 50A.

Figure 6:
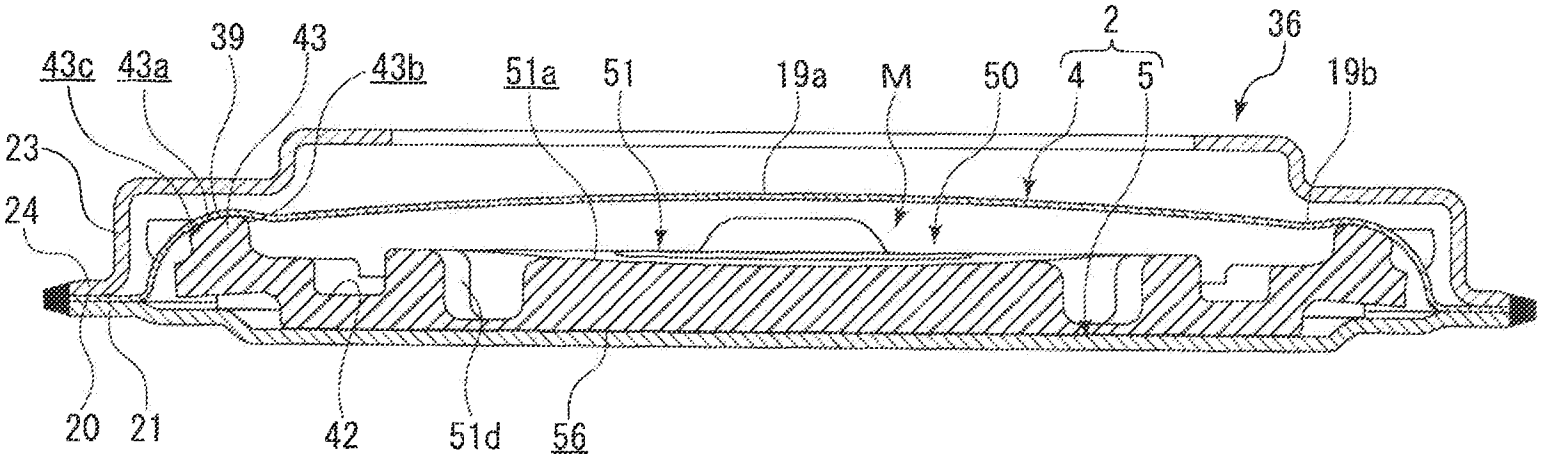
FIG. 6 is a cross-sectional view of a damper body in which the deformation-suppressing member in the second embodiment is provided.

As illustrated in FIG. 6, the deformation-suppressing member 50 of the second embodiment is disposed in the hermetically sealed space M formed between the diaphragm 4 and the plate 5 of the damper body 2 of the first embodiment, and the protruding end faces 43*a* of the protruding portions 43 are in contact with the inner surface, which is formed in a concave shape, of the shoulder portion 39 of the diaphragm 4 at four positions in an annular shape on the surface portion 50A of the deformation-suppressing member 50 in a natural state.

Meanwhile, a stay member 36 having specifications different from those of the first embodiment is fixed to the damper body in which the deformation-suppressing member 50 of the second embodiment is disposed, but the invention is not limited thereto. For example, the same stay member 6 as that of the first embodiment may be fixed to the damper body.

Third Embodiment

Figure 7:
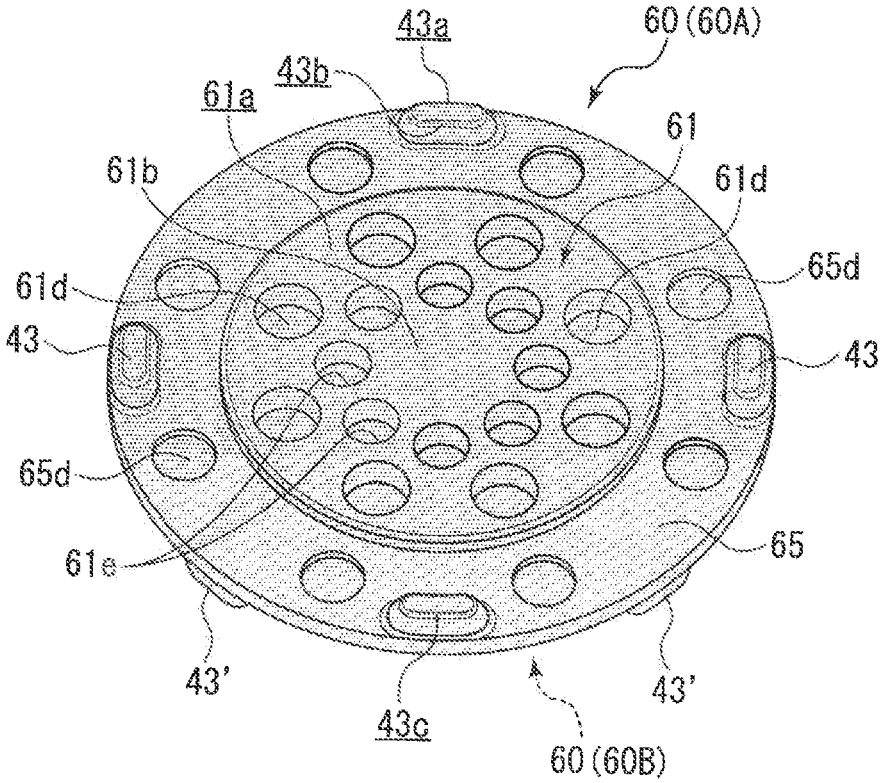
FIG. 7 is a perspective view illustrating a surface portion of a deformation-suppressing member of a damper device according to a third embodiment of the present invention.

Next, a damper device according to a third embodiment of the present invention will be described with reference to FIGS. 7 to 8. Meanwhile, the same components as those of the above-mentioned embodiment will be denoted by the same reference numerals as those of the above-mentioned embodiment, and the repeated description of the components and the effects thereof will be omitted.

A deformation-suppressing member 60 of the third embodiment includes a surface portion 60A that is a side to come into contact with the inner surface (that is, the surface facing a hermetically sealed space M) of a diaphragm 4A, and a back portion 60B that is a side to come into contact with the inner surface (that is, the surface facing the hermetically sealed space M) of a diaphragm 4B serving as an opposite member facing the diaphragm 4A. The surface portion 60A of the deformation-suppressing member 60 mainly includes a central portion 61 including a concave surface 61*a* and protruding portions 43. The concave surface

61*a* has a substantially circular shape in plan view, and forms a curved surface that is gradually concave with respect to the diaphragm 4A toward a center O in the radial direction. The protruding portions 43 are formed on a flat annular portion 65 closer to the outer peripheral side than the central portion 61, and protrude toward the diaphragm 4A. That is, the central portion 61 and the protruding portions 43 are formed to be spaced apart from each other in the radial direction with the flat annular portion 65 interposed therebetween.

The surface portion 60A of the deformation-suppressing member 60 will be described. First, recessed portions 61*e*, which are recessed toward the back portion 60B without penetrating the deformation-suppressing member 60, are formed at the central portion 61 so that a center portion 61*b* in the radial direction remains. The recessed portions 61*e* have the shape of a circular opening, and are formed at eight positions in total to be regularly arranged and spaced apart from each other in the circumferential direction.

Further, recessed portions 61*d*, which are recessed toward the back portion 60B without penetrating the deformation-suppressing member 60, are formed at positions closer to the outer peripheral side than the recessed portions 61*e* of the central portion 61. The recessed portions 61*d* have the shape of a circular opening having a diameter larger than the diameter of the recessed portion 61*e*, are formed at eight positions to be regularly arranged and spaced apart from each other in the circumferential direction, and are arranged in a phase different from the phase of the recessed portions 61*e* in the circumferential direction.

That is, the central portion 61 of the surface portion 60A includes a concave surface 61*a* that forms a concave curved surface at a portion except for these recessed portions 61*e* and 61*d*.

Next, the flat annular portion 65, which is formed of a flat surface not protruding toward the diaphragm 4A more than the central portion 61, is formed at a position closer to the outer peripheral side than the central portion 61; and the protruding portions 43 protruding toward the diaphragm 4A are provided at four positions on the flat annular portion 65 to be regularly arranged and spaced apart from each other at an angular interval of 90° in the circumferential direction. Further, recessed portions 65*d*, which are recessed toward the back portion 60B without penetrating the deformation-suppressing member 60, are formed between the protruding portions 43 adjacent to each other in the circumferential direction. The recessed portions 65*d* have the shape of a circular opening having the same diameter as the recessed portion 61*d*.

Next, the back portion 60B of the deformation-suppressing member 60 has a shape which is exactly the same as the shape of the above-mentioned surface portion 60A and in which all the components of the back portion 60B are arranged in a phase different from the phase of the components of the surface portion 60A by an angle of 45° in the circumferential direction. Accordingly, the protruding portions 43 of the surface portion 60A and protruding portions 43' of the back portion 60B are present at positions shifted from each other without being positioned on opposite sides.

That is, the above-mentioned protruding portions 43 and 43' are provided so that protruding portions are regularly arranged at four positions on each surface of the deformation-suppressing member 60, and are provided so that protruding portions are alternately and regularly arranged at eight positions on both surfaces of the deformation-suppressing member 60.

Figure 8:
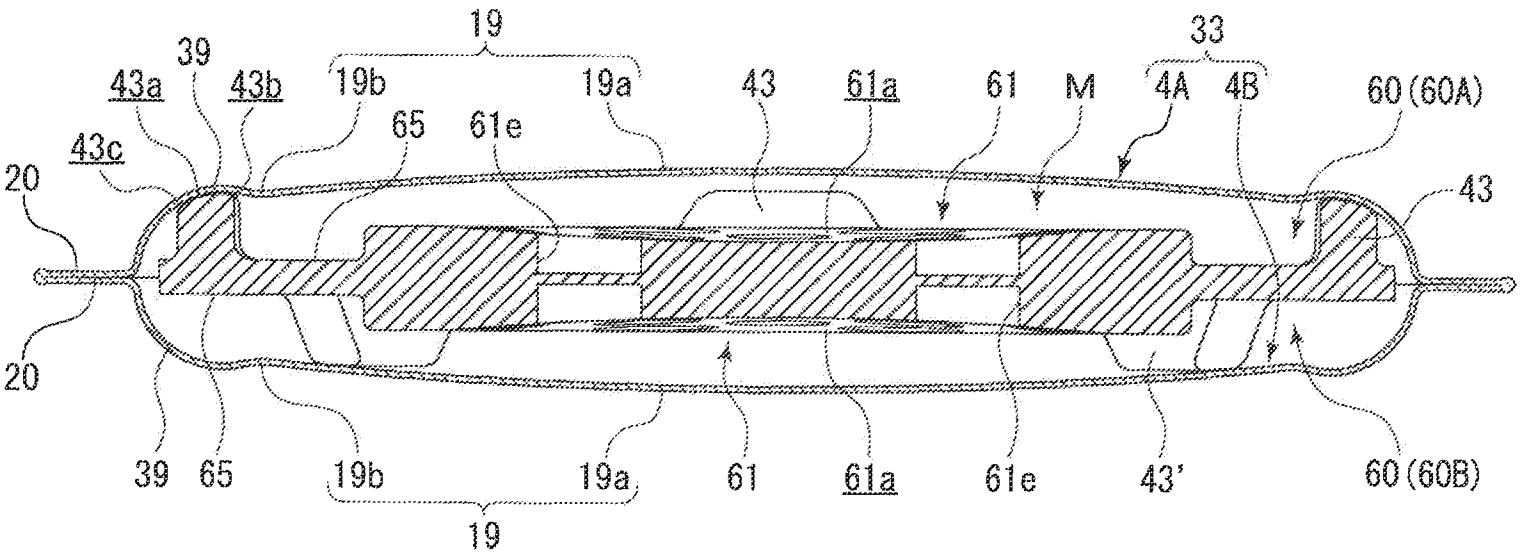
FIG. 8 is a cross-sectional view of a damper body in which the deformation-suppressing member in the third embodiment is provided.

As illustrated in FIG. 8, the deformation-suppressing member 60 of the third embodiment is disposed in the hermetically sealed space M formed between the diaphragm 4A that forms a damper body 33 and the diaphragm 4B that has the same shape as the diaphragm 4A and is connected to the diaphragm 4A in a hermetically sealed state by welding or the like; and the protruding end faces 43*a* of the protruding portions 43 are in contact with the inner surface, which is formed in a concave shape, of the shoulder portion 39 of the diaphragm 4A on the surface portion 60A of the deformation-suppressing member 60 in the natural state. Likewise, the protruding end faces 43*a* of the protruding portions 43' are in contact with the inner surface, which is formed in a concave shape, of the shoulder portion 39 of the diaphragm 4B on the back portion 60B of the deformation-suppressing member 60.

As described above, the protruding portions 43 of the surface portion 60A of the deformation-suppressing member 60 are fitted to the inner surface of the shoulder portion 39 of the diaphragm 4A, and the protruding portions 43' of the back portion 60B of the deformation-suppressing member 60 are fitted to the inner surface of the shoulder portion 39 of the diaphragm 4B. Accordingly, the deformation-suppressing member 60 is positioned with respect to the damper body 33 in the radial direction. For example, even though the position of the deformation-suppressing member 60 is shifted between the diaphragms 4A and 4B in the radial direction at the early stage of assembly, the position of the deformation-suppressing member 60 is adjusted since these diaphragms 4A and 4B are connected to each other by welding or the like.

In this contact state, the protruding portions 43 of the surface portion 60A of the deformation-suppressing member 60 are pressed toward the lower side in FIG. 8 by the inner surface of the shoulder portion 39 of the diaphragm 4A. However, the flat annular portion 65 of the back portion 60B is formed on the side opposite to the protruding portions 43 of the surface portion 60A and is spaced apart from the opposite diaphragm 4B. Accordingly, the deformation of the diaphragm 4A is allowed without obstruction. Likewise, the protruding portions 43' of the back portion 60B of the deformation-suppressing member 60 are pressed toward the upper side in FIG. 8 by the inner surface of the shoulder portion 39 of the diaphragm 4B. However, the flat annular portion 65 of the surface portion 60A is formed on the side opposite to the protruding portions 43' of the back portion 60B and is spaced apart from the opposite diaphragm 4A. Accordingly, the deformation of the diaphragm 4B is allowed without obstruction.

The embodiments of the present invention have been described above with reference to the drawings, but specific configuration is not limited to the embodiments. Even though modifications or additions are provided without departing from the scope of the present invention, the modifications or additions are included in the present invention.

For example, the deformation-suppressing members 40 and 50 include the through-holes 41*c* and 51*c* in the embodiments, but are not limited thereto. The deformation-suppressing members 40 and 50 may not include some or all of the through-holes. Further, the deformation-suppressing members 40, 50, and 60 include the recessed portions 41*d* and 45*d*, 51*d*, and 61*d*, 61*e*, and 65*d*, but are not limited thereto. The deformation-suppressing members 40, 50, and 60 may not include some or all of the recessed portions.

For example, the deformation-suppressing members 40, 50, and 60 include the concave surfaces 41*a*, 51*a*, and 61*a* that are continuous surfaces, but the present invention is not limited thereto. The concave surfaces may be protruding surfaces that are scattered in the radial direction or the circumferential direction.

For example, the plurality of protruding portions 43 are regularly arranged at four positions in the circumferential direction in the embodiments, but are not limited thereto. The plurality of protruding portions 43 may be regularly or irregularly arranged at a plurality of predetermined positions in the circumferential direction or may be arranged in an annular shape.

For example, the diaphragm 4 includes the main deformable portion 19*a*, the deformation base portion 19*b*, and the shoulder portion 39. However, the diaphragm 4 has only to be formed in the shape of a dish, and may include an arc-shaped shoulder portion and a main deformable portion having the shape of a flat plate.

REFERENCE SIGNS LIST

1 Damper device
2 Damper body
3 Diaphragm
4A Diaphragm
4B Diaphragm (opposite member)
5 Plate (opposite member)
5*c* Bottom
6 Stay member
10 High-pressure fuel pump
11 Fuel chamber
12 Plunger
13 Intake valve
14 Pressurizing chamber
15 Discharge valve
16 Device body
17 Cover member
19 Deformable-action portion
19*a* Main deformable portion
19*b* Deformation base portion
32 Damper body
33 Damper body
36 Stay member
39 Shoulder portion
40 Deformation-suppressing member
41 Central portion
41*a* Concave surface
41*c* Through-hole
41*d* Recessed portion
42 Annular groove
43 Protruding portion
43*a* Protruding end face
43*b* Curved surface
43*c* Curved surface
44 Base portion
45 Flat portion
45*d* Recessed portion
46 End face
47 First stepped portion
48 Second stepped portion (recess)
50 Deformation-suppressing member
51 Central portion
51*a* Concave surface
51*c* Through-hole
51*d* Recessed portion
51*e* Recessed portion
56 End face
60 Deformation-suppressing member
61 Central portion
61*a* Concave surface
61*d* Recessed portion
61*e* Recessed portion
65 Flat annular portion
65*d* Recessed portion

The invention claimed is:

1. A damper device provided in a flow channel of fluid for reducing pulsation of the fluid, comprising:

a diaphragm;

an opposite member that faces the diaphragm and is connected to the diaphragm in a hermetically sealed state over a circumferential direction; and a deformation-suppressing member that is disposed in a hermetically sealed space defined by the diaphragm and the opposite member, wherein the deformation-suppressing member includes a central portion that includes a concave surface of which a depth is increased toward a center in a radial direction thereof, and protruding portions that are provided closer to an outer peripheral side than the central portion, wherein:

the central portion and the protruding portions of the deformation-suppressing member are formed of an integrated elastic member, the diaphragm has a deformable-action portion formed at a center of the diaphragm and bulging in an axial direction, the deformation-suppressing member has a surface portion configured to be brought into contact with an inner surface of the diaphragm and a back portion configured to be brought into contact with the opposite member, the surface portion of the deformation-suppressing member has a central portion facing the deformable-action portion of the diaphragm, the back portion of the deformation-suppressing member has an end face that is formed coaxially with the deformable-action portion of the diaphragm to spread out on a back side of the central portion of the deformation-suppressing member, the end face of the deformation-suppressing member is brought into contact with the opposite member.

2. The damper device according to claim 1, wherein the central portion and the protruding portions of the deformation-suppressing member are spaced apart from each other in the radial direction.

3. The damper device according to claim 1, wherein the protruding portions of the deformation-suppressing member are arranged so as to be spaced apart from each other in the circumferential direction.

4. The damper device according to claim 1, wherein a recessed portion is formed on a surface of the deformation-suppressing member on which the protruding portions are formed.

5. The damper device according to claim 1, wherein the deformation-suppressing member is provided with a through-hole penetrating the deformation-suppressing member in an axial direction.

6. The damper device according to claim 1, wherein the deformation-suppressing member is provided with a recess, on a back side of the protruding portions of the deformation-suppressing member.

7. The damper device according to claim 1, wherein a curved surface following deformation of the diaphragm is formed on a protruding end face of each of the protruding portions on a radially inward side.

8. The damper device according to claim 1, wherein the diaphragm has a shoulder portion that bulges outward in the axial direction on an outer diameter side of the diaphragm, and each of the protruding portions has a curved surface formed along the shoulder portion of the diaphragm.

* * * * *